US006796766B2

(12) United States Patent
Hesse

(10) Patent No.: US 6,796,766 B2
(45) Date of Patent: Sep. 28, 2004

(54) ADJUSTABLE RADIAL PUMP, IN PARTICULAR FOR FEEDING A COOLING MEDIUM FOR A MOTOR VEHICLE

(75) Inventor: Ullrich Hesse, Affalterbach (DE)

(73) Assignee: Robert Bosch GmbH, Stuttgart (DE)

( * ) Notice: Subject to any disclaimer, the term of this patent is extended or adjusted under 35 U.S.C. 154(b) by 25 days.

(21) Appl. No.: 09/961,725

(22) Filed: Sep. 24, 2001

(65) Prior Publication Data

US 2002/0012583 A1 Jan. 31, 2002

Related U.S. Application Data

(63) Continuation of application No. 09/468,572, filed on Dec. 21, 1999, now abandoned.

(30) Foreign Application Priority Data

Jan. 14, 1999 (DE) ..... 199 01 123

(51) Int. Cl.[7] ..... F01B 25/02
(52) U.S. Cl. ..... 415/157; 415/158
(58) Field of Search ..... 415/157, 158

(56) References Cited

FOREIGN PATENT DOCUMENTS

DE 30 07 640 A1 9/1981

*Primary Examiner*—John Kwon
(74) *Attorney, Agent, or Firm*—Michael J. Striker

(57) ABSTRACT

An adjustable radial pump for feeding a cooling medium for a motor vehicle having a housing, a pump wheel provided with pump vanes, the pump wheel being supported in the housing and driven by a motor, the housing having at least one integrated inlet and outlet opening, an adjusting device for providing an adjustment of the medium to be fed independently from the rotary speed of the motor, the adjusting device being operatively connected with a sleeve which is adjustable by the adjusting device over the pump vanes in an axial direction.

9 Claims, 2 Drawing Sheets

ADJUSTABLE RADIAL PUMP, IN PARTICULAR FOR FEEDING A COOLING MEDIUM FOR A MOTOR VEHICLE

This is a continuation of application Ser. No. 09/468,572 filed Dec. 21, 1999 now abandoned.

BACKGROUND OF THE INVENTION

The present invention relates to a controllable radial pump, in particular for feeding a cooling medium for a motor vehicle.

Radial pumps are frequently used in the motor vehicles for cooling of the motor. The cooling medium is fed usually through a closed cooling circuit. The corresponding vehicles are as a rule provided with a single mechanical pump which is driven by a belt from the motor and in this way provides the circulation of the cooling medium. The direct coupling of such a cooling medium pump to the motor as a result determines the fed cooling medium speed from the rotary speed of the motor and therefore the adjustability of the cooling medium circulation is substantially limited.

These radial pumps which are used as cooling medium pumps must be dimensioned so that when they operate in a low rotary speed region and at high motor loads, for example mountain travels with a trailer, they must still provide sufficient cooling. The cooling efficiency and thereby the drive efficiency of the cooling medium pump is then designed for the normal region too high, which leads to unnecessarily high energy consumption. The German patent document DE 30 07 640 discloses adjustable drives for motor vehicle-cooling medium pumps, in which a transmission is arranged between the crankshaft of the internal combustion engine and the shaft of the water pump. Furthermore, switchable visco-couplings and hydraulic drives are known which are arranged in this region and guarantee an adjustability of the cooling medium pump. All these drives are characterized by losses, they are expensive both because of the technique and their dimensions, and they are not useable in all vehicle classes.

A basically different possibility with respect to the adjustability of the cooling medium pumps is the use of motor-independent, electrically driven pumps. This however can not be realized for large vehicles, which require pump drive powers within the range of up to 1 kW, since this can lead to big and heavy electric motors and generators.

SUMMARY OF THE INVENTION

Accordingly, its an object of present invention to provide an adjustable radial pump for motor vehicles which avoids the disadvantages of the prior art.

In keeping with these objects and with others which will become apparent hereinafter, one feature of present invention resides, briefly stated in an adjustable radial pump of this type, in which the adjusting device is operatively connected with a sleeve which is displaceable by the adjusting device over the pump vanes in an axial direction.

When the radial pump is designed in accordance with the present invention, volume stream of the medium to be fed, despite the direct drive from the motor, is adjustable independently from its rotary speed. This is made possible by the connection of the adjusting device with the sleeve arranged around the pump wheel, which is displaceable by the adjusting device over the pump vanes in the axial direction and thereby allows a variation of the size ratio of the pump chamber which receives the pump wheel.

In accordance with another feature of the present invention, the sleeve is cup-shaped and has a cup-bottom which is provided with slots for receiving the pump vanes. This makes possible a variation of the effective surface of the pump vanes variation The coupling of the adjusting movement of the adjusting device to the temperature of the medium fed by the pump is especially advantageous. Thereby the adjusting device can be switched for adjusting the volume stream so that with the increasing temperature of the medium, an increasing high pump power is provided. Then for example with the use of the pump in the motor vehicles with a cooled motor, the pump power and the required cooling medium volume are low, which can lead to a fast reaching of the optimal motor operation temperature. With higher loads and therefore higher motor or cooling medium temperatures, to the contrary, the pump power and the required cooling medium flow are maximum.

The coupling of the adjusting movement to the temperature makes possible in advantageous manner to operate with a temperature-sensitive element arranged in the pump wheel hub. The central arrangement is also advantageous from structural point of view, since then the centrifugal forces occurring during the rotation of the pump wheel are transmitted to the temperature-sensitive element only to a low degree.

The temperature-sensitive element in accordance with an advantageous embodiment of the invention can be formed as a growing expansion regulator or a growing motor, with which a linear displacement is possible in dependence on the temperature.

Electrically, hydraulically or pneumatically operated adjusting devices have the advantage that they can be realized with their complex regulation by means of a higher control device, for example with inclusion of the motor control. With the use in the motor vehicles, further optimization potential can be obtained, for example with respect to fuel consumption, exhaust gas emissions, and passenger comfort.

Specifically for cooling of a motor vehicle motor, the adjustability of the radial pump without being dependent from the rotary speed of the control provides additional advantages for optimization of the cooling process. It is advantageous when an adaptation of the pressure difference produced by the pump is possible to the pressure difference required for the cooling system. This is realized in a simple form by a suitable, adjustable slider in the inlet or outlet opening of the cooling medium pump.

The inventive features of the motor-independent adjustability can be realized by other structural approaches, for example by connecting the adjusting device with the vanes of the pump wheel. The connection is designed preferably so that the position of the pump vanes relative to the pump wheel can be changed and the required feeding quantity can be adjusted.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
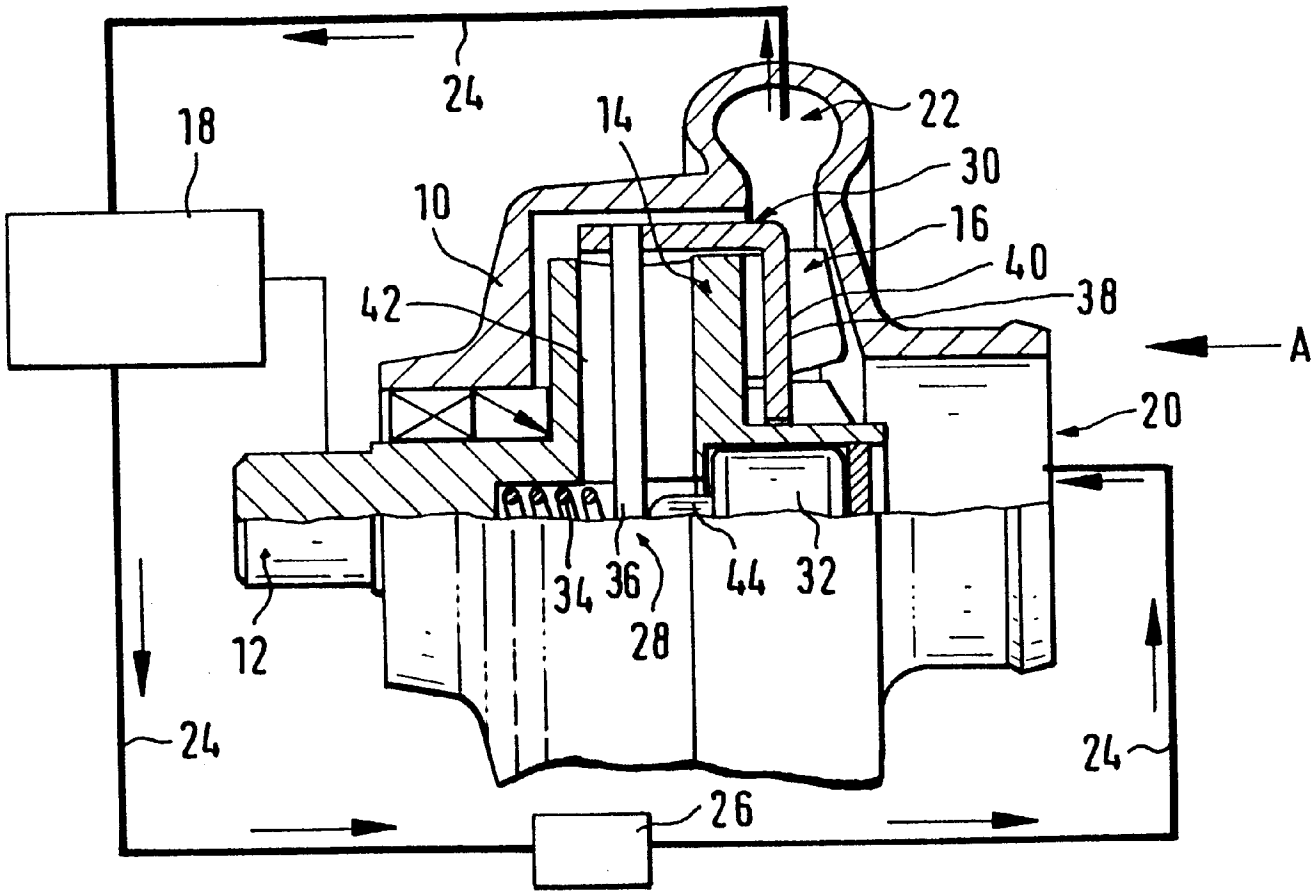
FIGS. 1 and 2 show a partially sectioned plan view of an adjustable radial pump in accordance with a corresponding embodiment of the invention, with peripheral components which are connected to the radial pump and illustrated symbolically.

An adjustable radial pump in accordance with the first embodiment is shown in FIG. 1. It is used for example for feeding a cooling medium for a motor vehicle. The radial pump has a shaft 12 which is rotatably supported in a housing 10 and fixedly connected with a pump wheel 14. Pump vanes 16 are arranged on the pump wheel 14 and during the operation rotate about the axis of the shaft 12. The drive of the shaft 12 and the pump wheel 14 is performed via a motor 18, which for example is connected with the shaft 12 through a not shown belt and a belt pulley.

During the rotation of the pump vanes 16 the medium to be fed flows in an axial direction through an inlet opening 20 in a pump chamber, which is integrated in the housing 10. The rotation of the pump vanes 16 in the radial direction provides feeding to an outlet opening 22 which is also integrated in the housing 10. Conduits 24 are connected to the openings 20 and 22 and provide a communication between the radial pump, the motor 18 and a cooler 26. A closed cooling circulation is therefore produced which is driven by the rotatable pump vanes 16 of the radial pump.

An adjusting device 28 is shown in FIG. 1. It is fixedly connected with the shaft 12 or the pump wheel 14. The adjusting device 28 is composed of a growing expansion regulator 32, a spring 34 and a first cylindrical pin 36 and is operatably connected with a sleeve 30. A paraffin-containing substance is located inside the growing expansion regulators 32 and expands with increasing temperature.

The sleeve 30 has the shape of a cup with a bottom 38 which is provided with slots 40. The shape of the slots 40 when seen in direction of the arrow A corresponds to the shape of the pump vanes 16. Thereby the sleeve 30 during mounting can be displaced with its open side over the pump wheel 14, and the pump vanes 16 can be received by the slots 40 of the bottom 38 and guided by them.

The first cylindrical pin 36 is located in an elongated opening 42 of the pump wheel 16 and held in it. It is connected by its both ends with the sleeve 30 which is axially displaceably supported to the pump wheel 14 and is fixed there. The central region of the pin 16 is in contact with a second pin 44 which can be displaced by the growing expansion regulator 32 in an axial direction. During heating of the medium to be fed, the second pin 44 is pressed against the first pin 46, which is displaced thereby against the force of the spring 34. This displacement actuates an axial displacement of the sleeve 30. Thereby the effective surface of the pump vanes 16 and thereby the feed power of the pump increases. As a result, also the cooling medium volume stream through the cooling circulation is increased.

If the temperature of the cooling medium decreases, it leads to a displacement of the sleeve 30 in the opposite direction. The effective surface of the pump vanes 16 is reduced and the feed power lowers. The cooling medium flow through the cooling circulation is reduced in this manner.

By increasing or reducing the effective depth of the pump vanes 16 in the above described manner, an adjustment of the cooling medium stream to be fed is provided independently from the rotary speed of the shaft 12 which is directly connected with a motor 18.

Figure 2:
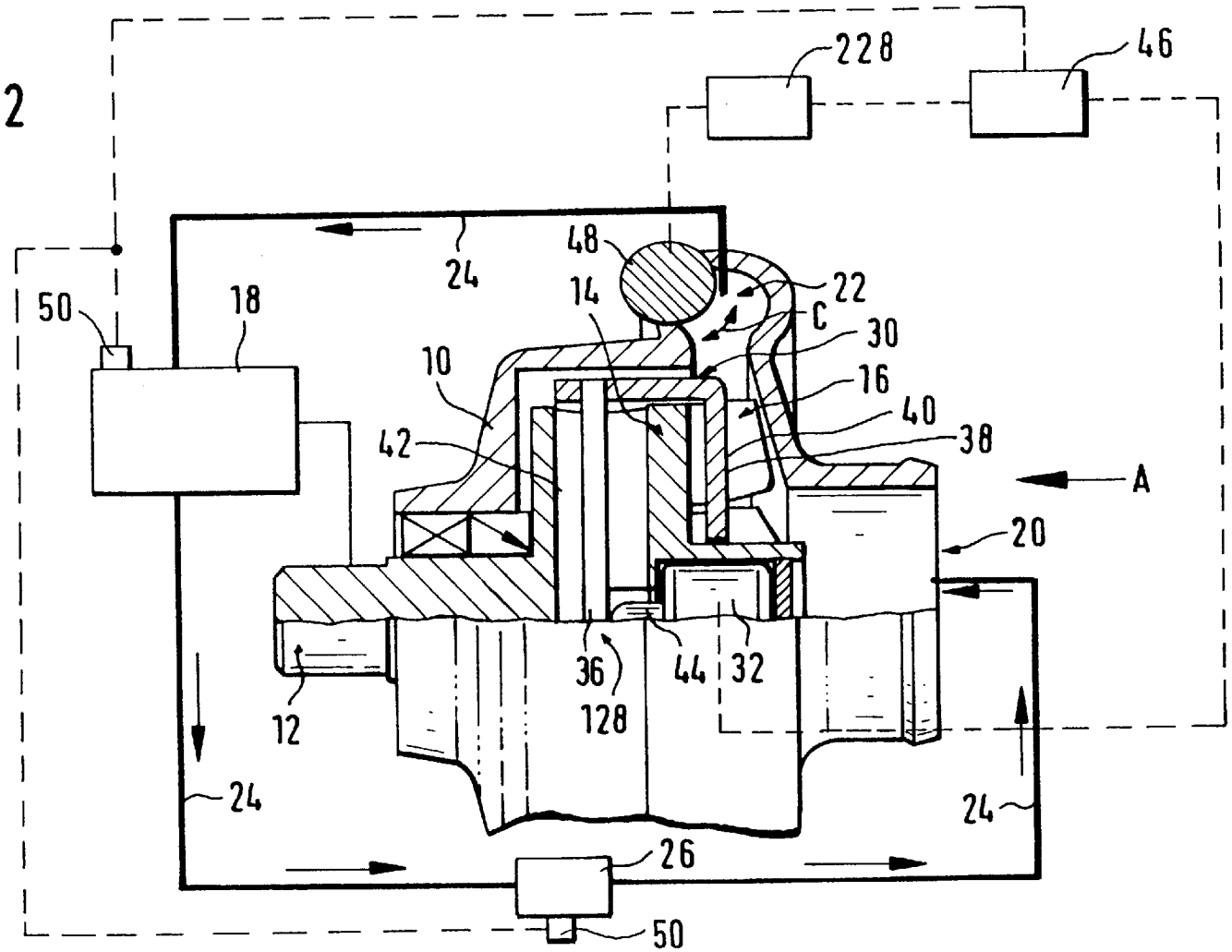

The adjustable radial pump in accordance with another embodiment of the invention is shown in FIG. 2 and is provided with an adjusting device 128. The adjusting device 128 is driven electrically, hydraulically or pneumatically and is in connection with a higher control device 36. In this manner the adjusting process can be controlled as adjusted in an optimal manner to the corresponding cooling requirement. The control device 46 permits a substantially complex control which goes beyond a purely temperature-dependent control, and also regulation of the cooling medium volume stream, in which the motor control can also be incorporated.

Starting from a very simple control variant, which for example with sensors provided at different location of the circulation circuit determines respective temperature as a control input value, intelligent variants are possible independently from the embodiment shown in FIG. 2. For example an increased circulation can be recognized before the measured temperatures are significantly increased. In such a control, for example the rotary speed of the motor, the transmission switching frequency or the speed or the inclination of the vehicle can be inputted.

FIG. 2 shows a slider 48 which provides an additional possibility of optimization of the cooling. It is operatably connected with the adjusting device 222 which is coupled to the control device 46. The slider 48 is arranged over the outlet opening 22 of the radial pump. It can be turned in direction of the arrow C through the outlet opening 22. Thereby, the possibility is provided for the outlet opening to be designed variably and to perform adaptation of the pressure different produced by the pump to the pressure difference required by the cooling system.

It will be understood that each of the elements described above, or two or more together, may also find a useful application in other types of constructions differing from the types described above.

While the invention has been illustrated and described as embodied in adjustable radial pump, in particular for feeding a cooling medium for a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An adjustable radial pump for feeding a cooling medium for a motor vehicle, comprising a housing; a pump wheel provided with pump vanes, said pump wheel being supported in said housing and driven by a motor, said housing having at least one integrated inlet and outlet opening; an adjusting device for providing an adjustment of the medium to be fed independently from the rotary speed of the motor, said adjusting device being operatively connected with a sleeve which is adjustable by said adjusting device over said pump vanes in an axial direction, said adjusting device being formed as a device which is selected from the group consisting of an electrically operated device, a hydraulically operated device and a pneumatically operated device.

2. An adjustable radial pump as defined in claim 1, wherein said sleeve is cup-shaped and has a cup bottom which is provided with a plurality of slots for receiving said pump vanes.

3. An adjustable radial pump as defined in claim 2, wherein said adjusting device is formed so that it provides an adjusting movement which is dependent on a temperature of the cooling medium.

4. An adjustable radial pump as defined in claim 3, wherein said pump wheel has a pump wheel hub; and further comprising a temperature-sensitive element arranged in said pump wheel hub.

5. An adjustable radial pump as defined in claim 4, wherein said adjusting device includes as a growing expansion regulator which displaces a sleeve against a force of an elastic element.

6. An adjustable radial pump as defined in claim 5, wherein said elastic element is formed as a spring.

7. An adjustable radial pump as defined in claim 1, wherein said adjusting device is connected with a control device.

8. An adjustable radial pump as defined in claim 1; and further comprising a controllable slider which is associated with at least one of said inlet opening and outlet opening.

9. An adjustable radial pump for feeding a cooling medium for a motor vehicle, comprising a housing; a pump wheel provided with pump vanes, said pump wheel being supported in said housing and driven by a motor, said housing having at least one integrated inlet and outlet opening; an adjusting device for providing an adjustment of the medium to be fed independently from the rotary speed of the motor, said adjusting device being operatively connected with a sleeve which is adjustable by said adjusting device over said pump vanes in an axial direction, said adjusting device being formed as a device which is selected from the group consisting of an electrically operated device, a hydraulically operated device and a pneumatically operated device; sensor means operative for determining at least one parameter selected from the group consisting of a rotary speed of a motor, a transmission switching frequency, a speed and an inclination of the vehicle; control means receiving informations from said sensor means and producing an adjusting signal for the pump based on an increased or a reduced cooling medium consumption so as to recognize an increased or reduced cooling medium consumption before a significant raise of measured temperatures.

* * * * *